United States Patent [19]

Ohtawa

[11] Patent Number: 4,702,613

[45] Date of Patent: Oct. 27, 1987

[54] ELECTRONIC TIMEPIECE DRIVEN BY A PLURALITY OF STEPPING MOTORS AND POWERED BY A SOLAR CELL

[75] Inventor: Shuzi Ohtawa, Tokyo, Japan

[73] Assignee: Seiko Instruments & Electronics Ltd., Tokyo, Japan

[21] Appl. No.: 835,969

[22] Filed: Mar. 4, 1986

[30] Foreign Application Priority Data

Mar. 5, 1985 [JP] Japan ..... 60-43243

[51] Int. Cl.[4] ..... G04C 23/00

[52] U.S. Cl. ..... 368/66; 368/205

[58] Field of Search ..... 368/66, 205, 157, 160

[56] References Cited

U.S. PATENT DOCUMENTS 4,398,832 8/1983 Maire et al. ..... 368/66

4,419,017 12/1983 Okuyama et al. ..... 368/66

FOREIGN PATENT DOCUMENTS 3115682 4/1982 Fed. Rep. of Germany ..... 368/66

89782 7/1980 Japan ..... 368/66

140668 8/1983 Japan ..... 368/66

*Primary Examiner*—Bernard Roskoski

*Attorney, Agent, or Firm*—Bruce L. Adams; Van C. Wilks

[57] ABSTRACT

An electronic timepiece which indicates time with a plurality of hands driven by a plurality of motors respectively, has an electric source comprised of energy supplementary means such as solar batteries and accumulating means such as secondary batteries. At least one of the motors is stopped when the remaining energy of the accumulating means becomes lower than a predetermined value, and the timepiece is corrected and driven to indicate the present time by correcting the suspended time when the driving of the motor restarts. Thus, time thereby measurement can be conducted for a long time, restraining the consuming amount of electricity.

19 Claims, 5 Drawing Figures

TO DETECTION CIRCUIT FOR ROTATION AND MAGNETIC FIELD
TO DETECTION CIRCUIT FOR ROTATION AND MAGNETIC FIELD
FROM EXTERNAL SWITCH
FROM VOLTAGE DETECTOR
FROM VOLTAGE DETECTOR
FROM EXTERNAL SWITCH
ZERO DETECTING CIRCUIT
60NOTATION U/D COUNTER
UP
DOWN
T-FF
64Hz
1Hz
P1
P2
P3
SP1
SP2

ELECTRONIC TIMEPIECE DRIVEN BY A PLURALITY OF STEPPING MOTORS AND POWERED BY A SOLAR CELL

BACKGROUND OF THE INVENTION (a) Field of Invention

This invention relates generally to a improved analogue electronic timepiece having a plurality of motors, more particularly, to an analogue timepiece which utilizes a solar battery and a large capacity condenser driven by an improved method.

(b) Description of the Prior Art

The conventional timepiece being actualized is a timepiece utilizing a clean energy source in which electric chemical reaction is not involved, and in which an amorphous solar cell having a relatively efficient converting ratio even at low luminous intensity, and a large capacity condenser based on the principle of electric duplicate layer, are combined together. The largest drawback of the above conventional type of an electronic timepiece is such that the operation continuance time of the timepiece when light is not emitted to the solar cell is much shorter than the operation continuance time of a conventional timepiece utilizing silver oxide batteries. The reason is that the energy stored in condensers is much smaller than that stored in silver oxide batteries, so the energy is quickly consumed by motors, IC, and such. In the present technology, it is an important theme that the consuming amount of electricity of the step motor rotating every second is lower than the consuming amount of electricity of the IC.

SUMMARY OF THE INVENTION

Accordingly, it is an object of this invention to provide an electronic timepiece driving a plurality of hands with a plurality of motors which make possible to drive the hands for a long time.

It is another object of this invention to provide an electronic timepiece which increases the operation continuance time when energy is not supplied from supplementary means, wherein the electronic timepiece is an analogue electronic timepiece powered by energy supplementary means and accumulating means.

It is further object of this invention to provide an electronic timepiece which stops at least one of motors when energy is not supplied from the supplementary means for a certain period and indicates the right present time when energy is supplied from the supplementary mean and the motor is driven again.

These and other objects of the invention which will become hereafter apparent are achieved by an electronic timepiece of this invention comprising; a step motor for driving the second hand which generally moves every second; a step motor for driving a hour hand and a minute hand which moves in intervals of every 20 to 60 seconds; an electric source composed of energy supplementary means such as solar batteries and accumulating means such as secondary batteries; detecting a means for detecting voltage of the accumulating means; and counting means which counts the suspension time of the second hand motors; wherein the second hand motor is stopped when the detecting means detects that the remaining energy of the accumulating means becomes lower than a determined value and then the suspention time of the second hand motor is counted by the counting means, and, when the energy of the accumlating means becomes higher than the determined value again and the motor restarts to drive, the timepiace is corrected and driven to indicate the present time by compensating the suspended time based on the counting means.

DESCRIPTION OF PREFERRED EMBODIMENT

Figure 2:
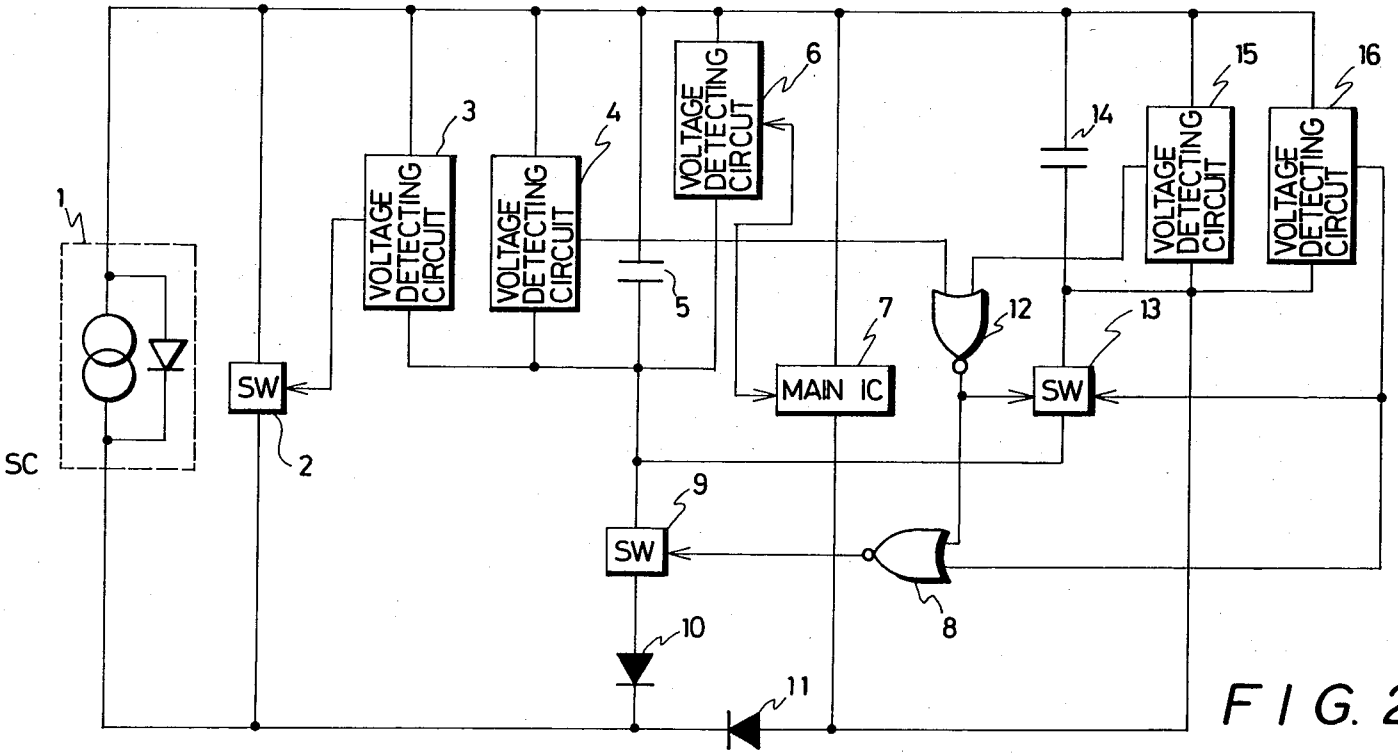
FIG. 2 is a block diagram of an electronic timepiece of the present invention.

The explanation of an embodiment of the present invention referring to the drawings is as follows. FIG. 2 is a total block diagram of an analogue electronic timepiece of the present invention. This timepiece is composed of an amorphous solar battery (solar cell) 1 for converting external optical energy to electric energy, a condenser or capacitor 5 and a condenser or capacitor 14 which store the energy from the solar battery and supplying power to the timepiece, and a main IC 7 as the main construction factor, and is further composed of voltage detecting circuits 3, 4, 6, 15, 16 of the condenser, switches (SW) 2, 9, 13, diodes 10, 11, and NOR circuits 8, 12.

At first, when energy is not stored in condenser 5, 14, and when no light is emitted or irradiated to solar cell 1, all of SW 2, SW 9, SW 13 are turned OFF. When light is emitted to solar cell 1 and when the potential of condenser 14 rises, the main IC starts to operate, and the sampling signal for voltage detection is generated. When the sampling signal becomes Hi or high level, the voltage of condenser 14 is detected by voltage detection circuit 15. When the value of voltage detection becomes a certain value (for example 2.2 V), SW 13 is kept turned OFF, and SW 2 is turned ON. Condenser 5 is charged from solar cell 1, while main IC 7 is driven by by condenser 14. Condenser 5 is an electric duplicate layer condenser with much larger capacity as compared to the capacity of condenser 14. Also, voltage detection circuit 16 turns SW 13 ON and SW 9 OFF when the voltage of condenser 14 becomes lower than a certain value (for example lower than 1.5 V). By repeating the above operation, energy is slowly stored in large capacity condenser 5. When the voltage of condenser 5 is detected by voltage detection circuit 6 to be more than a certain value (for example 1.5 V), SW 13 is turned OFF, and SW 9 is turned ON. When the voltage of condenser 5 becomes more than a certain value (for example 22 V), SW 2 is turned ON, and the condition becomes an overcharge preventing condition. The voltage of condenser 5 varies according to the amount of light emitted to solar 1 cell. BY detecting the voltage of this condenser 5 with voltage detection circuit 6 and by applying a corresponding signal to main IC 7, the rotation of one of the two motors (the motor for driving the second hand) is controlled. Diodes 10, 11 are diodes for preventing a reverse current.

Figure 1:
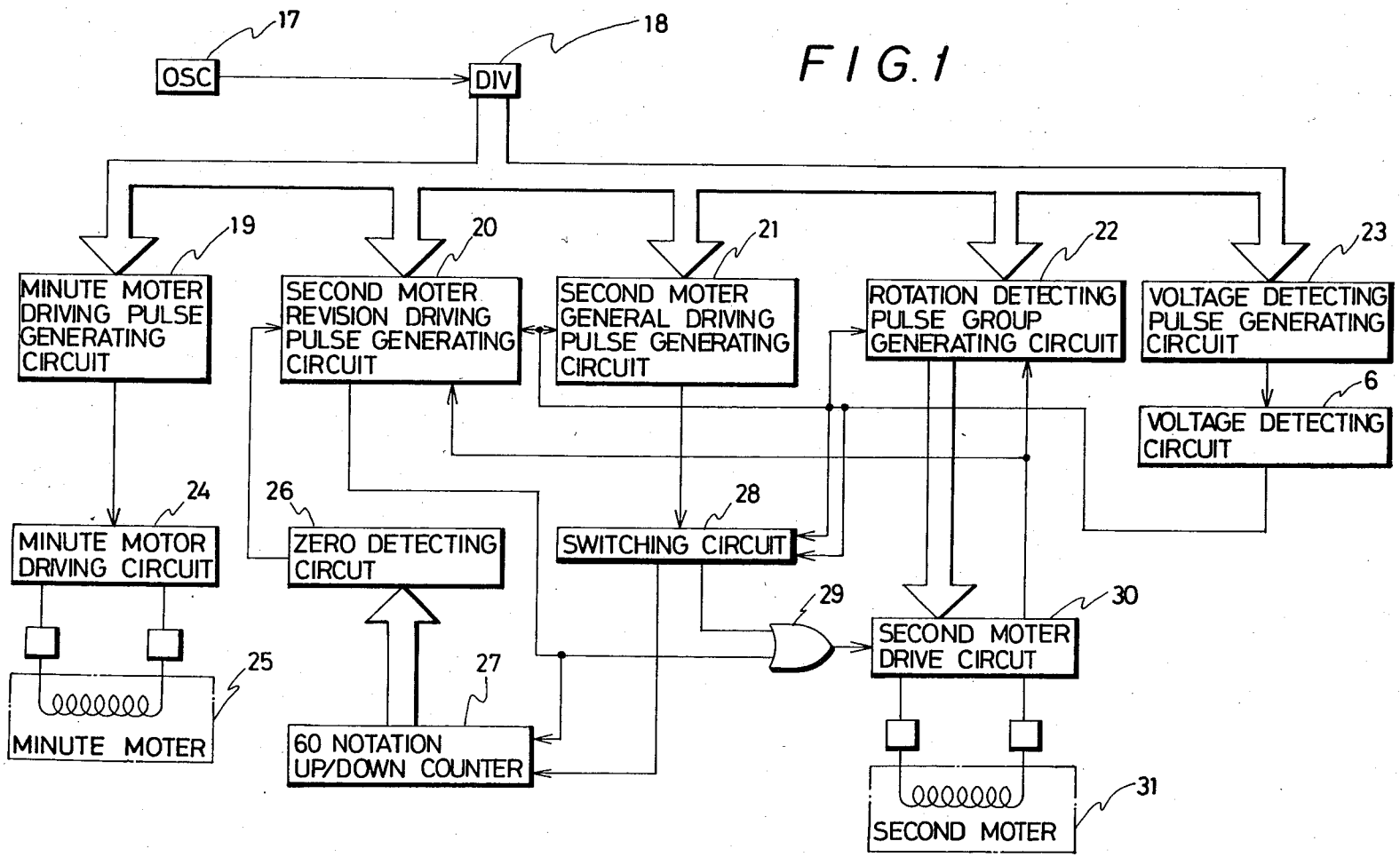
FIG. 1 is a block diagram of a motor driving controlling portion of the present invention.

FIG. 1 is a block diagram of the motor drive control portion of the analogue timepiece of the present invention.

All the parts other than voltage detection circuit 6, a minute hand motor 25, a second hand motor 31, are built in main IC 7. To this motor drive control portion, the following circuits are connected; a dividing circuit (DIV) 18 which divides a signal from an oscillating circuit (OSC) 17; a minute hand motor driving pulse generating circuit 19 for producing minute hand driving pulses obtained by synthesizing the signal from dividing circuit 18; a second hand motor correction driving pulse generating circuit 20; a second hand motor driving pulse generating circuit 21; a rotation detecting pulse group generating circuit 22; and a voltage detecting pulse generating circuit 23. From minute hand motor driving pulse generating circuit 19, a signal is sent to a minute hand motor driving circuit 24 at a longer period i.e., every 20 seconds, and minute hand motor 25 is stepwisely driven at every 20 seconds. Second hand motor 31 is driven to undergo the low electricity consumption driving with presently practiced correction drive method. First, the signal from second hand motor driving pulse generating circuit 21 is inputted to a second hand motor drive circuit 30 through a switching circuit 28. The second hand motor 31 is driven by second hand motor drive circuit 30 at a shorter period. Immediately after the second hand motor is driven, the detection of the rotation of the motor is conducted by the signal from rotation detecting pulse group generating circuit 22. When the second hand drive motor is not rotating, the second hand drive motor is driven additionally by the signal $P_2$ from the second hand drive motor correction driving pulse generating circuit within 50 m sec. after application of the normal drive pulse $P_1$. Voltage detection pulse generating circuit 23 outputs sampling pulses to detect the output voltage of condenser 5 representative of the stored amount of the electric energy. When the voltage of condenser 5 becomes lower than a certain value (for example lower than 1.3 V), second hand motor driving pulse generating circuit 21 does not output the normal drive pulse P1, nor does second hand motor correction driving pulse generating circuit 20 output the correction drive pulse P2, and the second hand motor stops or suspends driving thereof. After that, the second hand motor drive pulse $P_1$ is inputted to a 60 notation UP/DOWN counter 27, and the regular position of the second hand is memorized. Then, when the voltage of condenser 5 becomes high again, the correction drive pulses from second motor correction driving pulse generating circuit 21 are applied to second hand motor 31, the pulse width of which being shorter than the pulse width of the non-rotating correction driving pulse $P_2$. The correction driving pulse at this time is outputted until the fast forwarding signal of 64 Hz becomes 0 at a zero detecting circuit 26. As the pulse width is shorter than that of the pulse $P_2$ at non-rotating time, the power consumption of the motor becomes smaller, and because electricity is consumed less than at non-rotating time, consumed electricity of condenser 5 is small. Separately from the second hand motor, minute motor 25 is driven through minute hand motor driving pulse generating circuit 19 and through minute hand motor driving circuit 24.

Figure 3:
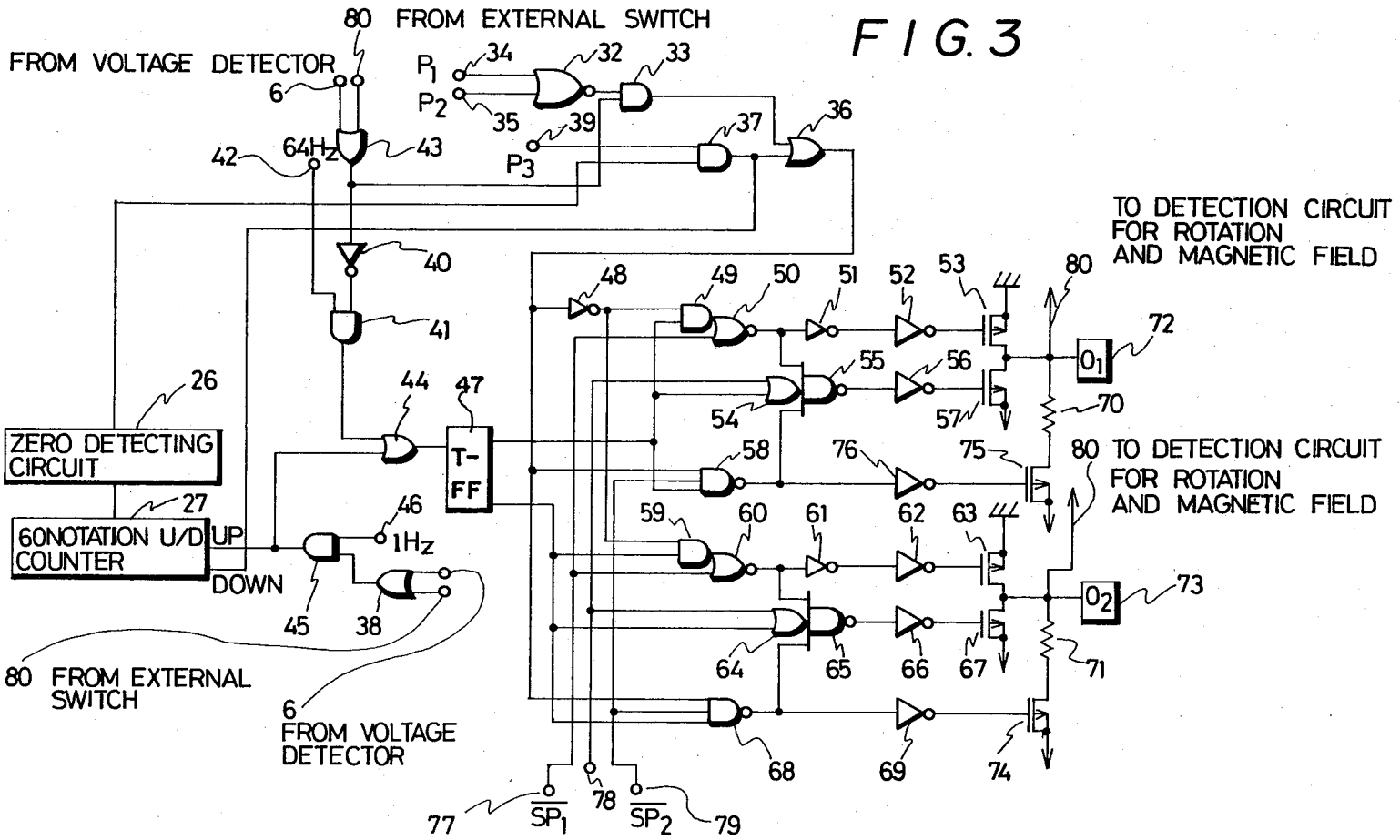
FIG. 3 is a circuit diagram of a second hand driving controlling portion of a second hand driving motor.
Figure 4:
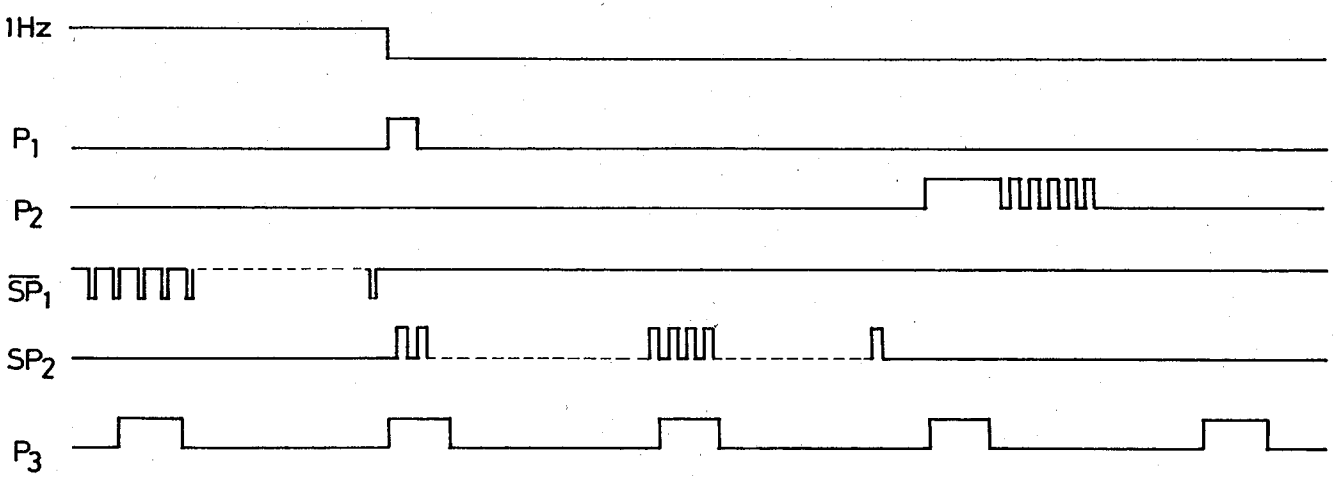
FIG. 4 is a timing chart of an input terminal of a circuit diagram shown in FIG. 3.

FIG. 3 shows the driving circuit and the control circuit of the second hand motor of the present invention. FIG. 4 shows a timing chart of the input terminal shown in FIG. 3. $P_1$ is the normal drive pulse outputted every second from second hand motor driving pulse generating circuit 21, its pulse width being short. $P_2$ is outputted from second motor correction driving pulse generating circuit 20 under and non-rotating condition.

$P_1$, $P_2$ are inputted into AND gate 33 through NAND gate 32. Onto one of the input terminals of AND gate 33, the output terminal of voltage detection circuit 6 is connected, but no output is produced when the voltage of condenser 5 is small. The output terminal of AND gate 33 is connected to the first input terminal of OR gate 36. The output terminal of voltage detection circuit 6 is connected to AND gate 37 through OR gate 43. To the other input terminal 80 of OR gate 43, the signal which is generated by operating an external switch is connected. To one of the two input terminals of AND gate 37, the fast forwarding signal of 64 Hz is connected, and to the other input terminal, the output of zero detection circuit 26 is connected. The output of AND gate 37 outputs pulse P3 until the zero detection circuit 26 works, when the voltage of voltage detecting circuit 6 becomes high again. Further, this output terminal of AND gate 37 is connected to the DOWN input terminal of 60 notation UP/DOWN counter 27, and is also connected to the second input terminal of OR gate 36. The output terminal of OR gate 36 is connected to NAND gate 48 and to the first input terminal of NAND gate 68, and is also connected to the first input terminals of AND gates 49, 59 through inverter 48. The output terminal of voltage detection circuit 6 is connected to AND gate 45 through OR gate 38, and is also connected to AND gate 41 through OR gate 43 and through inverter 40. The other input terminal of AND gate 45 receives 1 Hz signal. The output from AND gate 45 is inputted to 60 notation UP/DOWN counter 27 as the UP data of 60 notation UP/DOWN counter 27, and is connected to the second input terminal of OR gate 44. The other input terminal of AND gate 41 receives 64 Hz signal. The output terminal of AND gate 41 is connected to the first input terminal of OR gate 44. The output terminal of OR gate 44 is connected to the T input terminal of T-FF 47, and the Q output terminal of T-FF is connected to the second input terminal of AND gate 49, the third input terminal of NAND gate 58, and to the second input terminal of OR gate 54. The $\overline{Q}$ output terminal of T-FF 47 is connected to the second input terminal of AND gate 59, and to the third input terminal of NAND gate 68. Terminal 77 receives a pulse $\overline{SP_1}$ with which the second hand motor moves two seconds at a cycle of two seconds, when the voltage of condenser 5 becomes within a certain range (for example 1.5 V to 1.3 V). Terminal 78 receives a sampling pulse to detect the alternating magnetic field. Terminal 79 receives a sampling pulse detect rotation to. Terminal 77 is connected to NOR gates 50, 60. Terminal 78 is connected to the input terminals of OR gates 54, 64. Terminal 79 is connected to the third input terminals of NAND gates 58, 68. The output terminal of NOR gate 50 is connected to a gate terminal of P channel MOSFET 53 through inverters 51, 52, and is also connected to input terminal of NAND gate 55. The output terminal of NAND gate 58 is connected to a gate of N channel MOSFET 75 for detection through inverter 76, and is also connected to an input terminal of NAND gate 55. The output terminal of NAND gate 55 is connected to the gate input terminal of N channel MOSFET 57 through inverter 56. The output terminal of NOR gate 60 is connected to a gate of P channel MOSFET 63 through inverters 61, 62, and is also connected to an input terminal of NAND gate 65. The output of NAND gate 68 is connected to a gate of N channel MOSFET 74 for detection through inverter 69, and is also connected to an input terminal of NAND gate 65. The output terminal of NAND gate 65 is connected to a gate of N channel MOSFET 67 through inverter 66. The drains of P MOSFET 53 and N MOSFET 57 are mutually connected to form output terminal OUT 72 of the second hand motor, and are connected to a drain of N MOSFET 75 through high resistance 70. BY utilizing a terminal of OUT 72, the detection of the motor rotation and the detection of alternating magnetic field are conducted. The sources of P MOSFETS 53, 63 are connected to $V_{DD}$, and the sources of N MOSFETS 57, 75, 67, 74 are connected to $V_{SS}$. The drains of P MOSFET 63 and N MOSFET 67 are mutually connected to form output OUT 73 of the second hand driving motor, and are connected to the drain of N MOSFET 74 for detection through high resistance 71. By utilizing this terminal 73, the detection of the motor rotation and the detection of alternating magnetic field are conducted.

Figure 5:
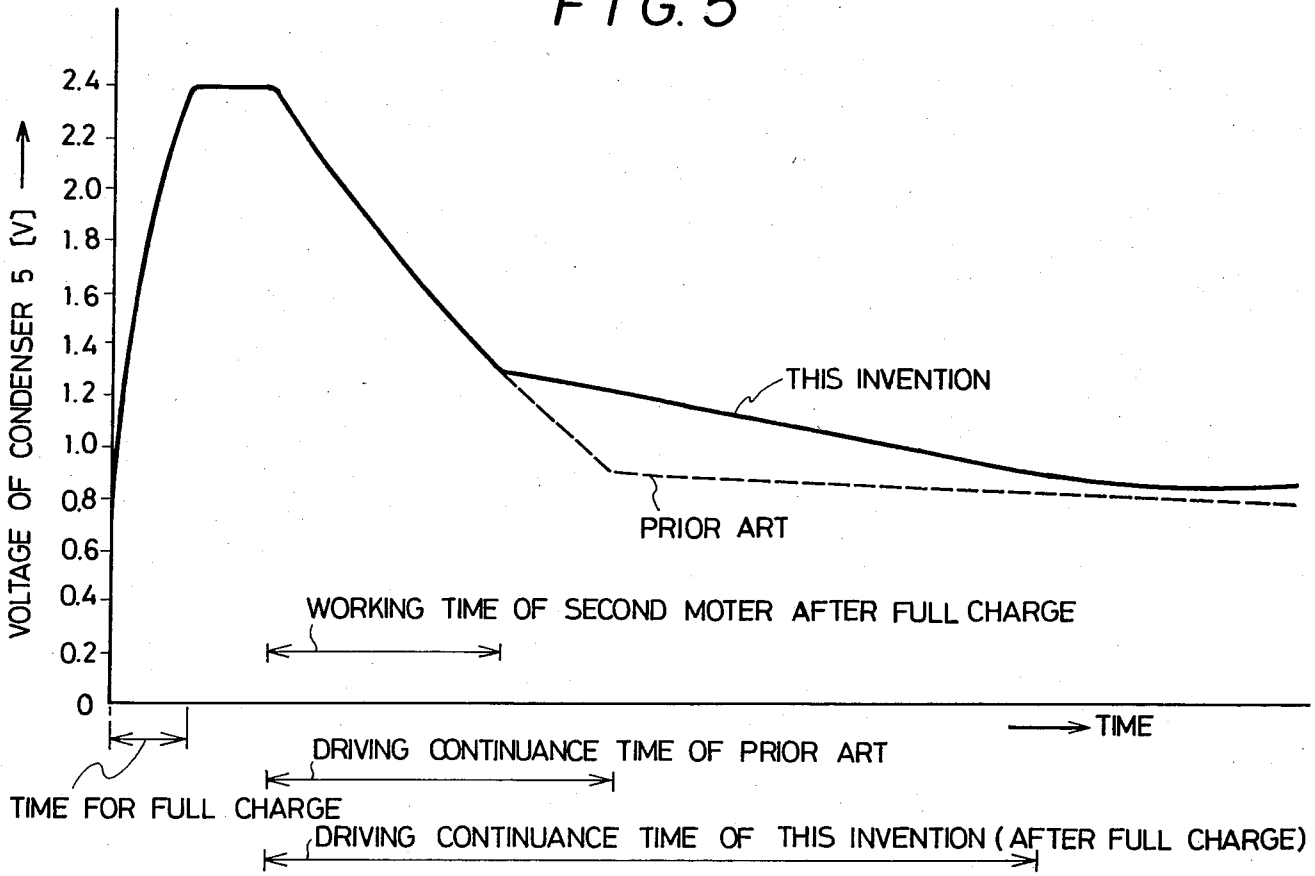
FIG. 5 shows the relationship between a driving continuance time and a voltage of acumulating means.

FIG. 5 shows an effect of the present invention. The longitudinal axis shows the voltage of condenser 5. The lateral axis shows the elapsed time. The dotted line represents the result obtained by a conventional driving method, and the solid line represents the result of the present invention. When light is irradiated to solar battery under a condition where the voltage of condenser 5 is OV, the voltage gradually rises, the over charge preventing circuit works when the voltage rises to 2.4 V, and then the voltage is clamped. Then when light is not irradiated to the solar battery, the voltage of condenser 5 gradually decreases due to electricity consumption by IC and by the motor, and by the self-discharge of the condenser. According to the present invention, the second hand driving motor is stopped when the voltage of condenser 5 becomes 1.30 V, and the 60 notation UP/DOWN counter operates and memorizes the position of the second hand.

Then, only the minute hand driving motor continues its operation until the voltage becomes 0.9 V. At this point (until the voltage is 0.9 V), the curve of the condenser voltage is a gentle slope because the consumed electricity of the motor is small. When the voltage of the condenser becomes 0.9 V, the minute motor also stops and the whole timepiace comes to a stop. With the conventional method, the second hand motor could not be stopped and so the curve of the condenser voltage is steep, and as in the present invention, the operation of the motor stops at voltage 0.9 V. The working time of the motor after the full charge of the condenser is shown in FIG. 5. According to the present invention, an electronic timepiece greatly increases the operation continuance time when energy is not supplied from supplementary means, wherein the electronic timepiece is an analogue electronic timepiece comprising energy supplementary means and condensing means.

Though not explained in the present application, it is clear that it is possible to stop and drive the second hand motor by operating the outer operation switch of the timepiece shown in FIG. 3. Therefore, by being operated by the user, it is possible to indicate the minute and hour for a long time.

What is claimed is:

1. An electronic timepiece comprising: oscillating means for generating a time standard signal; dividing means for receiving said time standard signal and generating a plurality of divided signals; a plurality of pulse generating means for receiving said divided signals and generating a plurality of driving pulses; a plurality of driving means for receiving said driving pulses; a plurality of step motors each driven by said driving means; a plurality of hands driven by respective ones of said step motors for indicating time; energy supplementary means for generating electric energy; accumulating means for storing said electric energy; detecting means for detecting an output voltage of said accumulating means representative of the amount of the electric energy stored in the accumulating means and generating a detection signal effective to suspend at least one of said step motors when the output voltage becomes below a predetermined value; counting means for counting the suspension time during which the step motor is suspended; and control means for correcting the position of the step motor after cancellation of suspension thereof to position the hand driven thereby to indicate the present time according to an output from said counting means.

2. An electronic timepiece as claimed in claim 1; wherein said supplementary means comprises a solar cell.

3. An electronic timepiece as claimed in claim 1; wherein said accumulating means comprises a capacitor.

4. An electronic timepiece as claimed in claim 1; wherein said pulse generating means includes means cooperative with the control means for generating a correction driving signal having a frequency higher than 1 Hz to effect the correction of the suspended step motor.

5. An electronic timepiece as claimed in claim 1; wherein said hands comprise a second hand, a minute hand and an hour hand.

6. An electronic timepiece as claimed in claim 5; wherein said suspended step motor is used for driving the second hand.

7. An electronic timepiece as claimed in claim 5; wherein another of the step motors is used for driving the minute and hour hands.

8. An electronic timepiece as claimed in claim 6; wherein said suspended step motor is normally driven stepwise every second.

9. An electronic timepiece as claimed in claim 7; wherein said another step motor is driven stepwise at an interval of 20 to 60 seconds.

10. An electronic timepiece comprising: a set of hands; a plurality of stepping motors for stepwisely driving respective ones of the hands at different periods to indicate time in different time units; driving means for producing and applying drive pulses having the different periods to respective ones of the stepping motors to drive the same at the different periods; power source means comprised of converting means for converting external non-electric energy to electric energy, and storing means charged by the converting means for storing and discharging the electric energy to thereby supply power to the electronic timepiece; detecting means for detecting an output voltage of the storing means representative of the amount of electric energy stored therein and producing a corresponding detection signal; and controlling means responsive to the detection signal and operative when the output voltage of the storing means falls below a predetermined value due to momentary interruption of the energy conversion in the converting means for controlling the driving means to cause the same to suspend the stepwise drive of one of the stepping motors driven by drive pulses having the shortest period to thereby reduce the consumption of the electric energy stored in the storing means.

11. An electronic timepiece as claimed in claim 10; wherein the controlling means includes counting means connected to the driving means for counting the number of drive pulses produced by the driving means but not applied to said one stepping motor during the suspension thereof.

12. An electronic timepiece as claimed in claim 11; wherein the controlling means includes correcting means connected to the counting means for enabling the driving means to apply a counted number of correction drive pulses to said one stepping motor to correct the position of the same after the release of suspension thereof to thereby indicate the present time.

13. An electronic timepiece as claimed in claim 12; wherein the driving means includes correction driving means for producing the correction drive pulses to effect rapid correction of said one stepping motor immediately after the release of suspension thereof.

14. An electronic timepiece as claimed in claim 10; wherein the set of hands comprises an hour hand, a minute hand and a second hand.

15. An electronic timepiece as claimed in claim 14; wherein the plurality of stepping motors comprise a first stepping motor for driving the hour and minute hands at a relatively longer period, and a second stepping motor for driving the second hand at a relatively shorter period.

16. An electronic timepiece as claimed in claim 15; wherein the first stepping motor is driven at a period of 20–60 seconds, and the second stepping motor is driven at a period of 1 second.

17. An electronic timepiece as claimed in claim 16; wherein the controlling means includes means for effecting only the suspension of the second stepping motor.

18. An electronic timepiece as claimed in claim 10; wherein the converting means comprises a solar cell for converting optical energy irradiated thereon to electric energy.

19. An electronic timepiece as claimed in claim 10; wherein the storing means comprises a capacitor.

* * * * *